US007562472B2

(12) United States Patent
Tozawa et al.

(10) Patent No.: US 7,562,472 B2
(45) Date of Patent: Jul. 21, 2009

(54) WORK MACHINE

(75) Inventors: Shoji Tozawa, Tokyo (JP); Madoka Binnaka, Tokyo (JP); Hideto Furuta, Tokyo (JP)

(73) Assignee: Caterpillar Japan Ltd., Tokyo (JP)

( * ) Notice: Subject to any disclaimer, the term of this patent is extended or adjusted under 35 U.S.C. 154(b) by 376 days.

(21) Appl. No.: 11/575,045

(22) PCT Filed: Apr. 10, 2006

(86) PCT No.: PCT/JP2006/007532

§ 371 (c)(1),
(2), (4) Date: Mar. 9, 2007

(87) PCT Pub. No.: WO2006/129422

PCT Pub. Date: Dec. 7, 2006

(65) Prior Publication Data

US 2009/0077837 A1 Mar. 26, 2009

(30) Foreign Application Priority Data

Jun. 2, 2005 (JP) ..... 2005-162511
Jun. 2, 2005 (JP) ..... 2005-162512

(51) Int. Cl.
*E02F 5/02* (2006.01)
*F16D 31/02* (2006.01)

(52) U.S. Cl. ..... 37/348; 60/421

(58) Field of Classification Search ..... 37/348, 37/379, 435, 443, 414, 466; 60/421–429, 60/468, 430, 562, 533, 581; 91/516, 524, 91/523; 172/2–12; 414/517, 525.6, 516, 414/510, 509, 525.1
See application file for complete search history.

(56) References Cited

U.S. PATENT DOCUMENTS

| | | | | |
|---|---|---|---|---|
| 4,898,078 | A * | 2/1990 | Gage et al. | 91/524 |
| 6,079,933 | A * | 6/2000 | Moyna et al. | 414/517 |
| 6,321,535 | B2 * | 11/2001 | Ikari et al. | 60/421 |
| 6,658,843 | B1 * | 12/2003 | Kauss | 60/468 |
| 7,251,934 | B2 * | 8/2007 | Lech et al. | 60/430 |

FOREIGN PATENT DOCUMENTS

| | | |
|---|---|---|
| JP | 2004-84470 | 3/2004 |
| JP | 2004-190845 | 7/2004 |

OTHER PUBLICATIONS

International Search Report for PCT/JP2006/307532 mailed Aug. 1, 2006.

* cited by examiner

*Primary Examiner*—Robert E Pezzuto
(74) *Attorney, Agent, or Firm*—Darby & Darby P.C.

(57) ABSTRACT

A boom control circuit for controlling hydraulic fluid fed to a boom cylinder is provided separately and independently from a travel/stick/bucket control circuit, which serves to control hydraulic fluid fed to travel motors, a stick cylinder, and a bucket cylinder. The boom control circuit includes a boom pump, an energy recovery motor disposed in a return passage through which return fluid from the boom cylinder 8*bmc* passes, and a boom motor generator connected to the energy recovery motor. The aforementioned boom pump is connected through a clutch to the boom motor generator. The invention is capable of providing a work machine of which a boom control circuit is adapted to function independently so that the flow rate required by the boom control circuit can be easily ensured.

17 Claims, 3 Drawing Sheets

WORK MACHINE

CROSS REFERENCE TO PRIOR APPLICATION

This is a U.S. national phase application under 35 U.S.C. § 371 of International Patent Application No. PCT/JP2006/307532 filed Apr. 10, 2006 and claims the benefit of Japanese Application No. 2005-162511 filed Jun. 2, 2005 and Japanese Application No. 2005-162512 filed Jun. 2, 2005, all of which are incorporated by reference herein. The International Application was published in Japanese on Dec. 7, 2006 as International Publication No. WO 2006/129422 under PCT Article 21(2).

TECHNICAL FIELD

The present invention relates to a work machine provided with a hybrid type drive device.

BACKGROUND ART

A driving system for a work machine, such as a hydraulic excavator, may include a hybrid type drive system that has an electric generator, which is adapted to be driven by an engine, and an electric power storage device for storing electric power generated by the generator. An electric motor or a motor generator is operated by power supplied from either one of or both the generator and the electric power storage device and drives a pump or a pump motor.

For example, a boom control circuit for controlling a boom cylinder is adapted to drive a pump motor by operating a motor generator by means of electric power supplied from the generator or the electric power storage device. A stick control circuit for controlling a stick cylinder is adapted to drive a stick pump, i.e. a pump for a stick, by operating a stick motor, i.e. a motor for a stick, by means of electric power supplied from the generator or the electric power storage device. A bucket control circuit for controlling a bucket cylinder is adapted to drive a bucket pump by operating a bucket motor by means of electric power supplied from the generator or the electric power storage device. The boom control circuit, the stick control circuit, and the bucket control circuit are connected to one another by a plurality of supporting circuits that serve to feed hydraulic fluid to one another.

A boom cylinder driving circuit is a closed circuit including a bi-directional type pump motor and a motor generator. The bi-directional type pump motor is adapted to function as a pump for feeding hydraulic fluid and also function as a hydraulic motor driven by hydraulic fluid fed thereto. The motor generator is adapted to be driven by electric power supplied from the generator or the electric power storage device so as to function as an electric motor for driving the pump motor and also adapted to be driven by the pump motor so as to function as a generator for generating electric power (e.g. See Japanese Laid-open Patent Publication No. 2004-190845 (page 1, page 7, and FIG. 1)).

Whereas the boom control circuit requires a high flow rate the bucket control circuit requires a high pressure. Therefore, it is difficult to control the plurality of supporting circuits so that they satisfy these requirements.

Furthermore, the aforementioned combination of the pump motor and the motor generator is limited to a closed circuit and cannot be applied to an open circuit that serves to direct return fluid discharged from hydraulic actuators back to a tank.

In order to solve the above problems, an object of the invention is to provide a work machine of which a boom control circuit is adapted to function independently so that the flow rate required by the boom control circuit can be easily ensured. Another object of the invention is to provide a work machine wherein energy of return fluid discharged from hydraulic actuators can be effectively recovered even in an open circuit.

SUMMARY OF THE INVENTION

The present invention relates to a work machine including a lower structure adapted to be driven by a travel motor, an upper structure that is rotatable on the lower structure by a swing motor generator, and a work equipment that is mounted on the upper structure and comprises a boom, a stick, and a bucket, wherein the work machine further includes a hybrid type drive system, a travel/stick/bucket control circuit, a boom control circuit, and a swing control circuit. The boom, the stick, and the bucket of the work equipment are sequentially connected and adapted to be pivoted by a boom cylinder, a stick cylinder and a bucket cylinder respectively. The hybrid type drive system comprises an engine, a motor generator, an electric power storage device, and a main pump. The motor generator is adapted to be driven by the engine so as to function as a generator as well as receive electric power so as to function as an electric motor. The electric power storage device serves to store electric power fed from the motor generator functioning as a generator, as well as feed electric power to the motor generator functioning as an electric motor. The main pump is adapted to be driven either one of or both the engine and the motor generator. The travel/stick/bucket control circuit serves to control hydraulic fluid fed from the main pump of the hybrid type drive system to the travel motor, the stick cylinder, and the bucket cylinder. The boom control circuit includes a boom pump, which is provided separately from the main pump of the hybrid type drive system, the boom control circuit serving to control hydraulic fluid fed from the boom pump to the boom cylinder. The swing control circuit serves to feed electric power from the electric power storage device of the hybrid type drive system to the aforementioned swing motor generator so that the swing motor generator functions as an electric motor. Another function of the swing control circuit is to recover to the electric power storage device electric power generated by the swing motor generator functioning as a generator during braking of rotating motion of the upper structure. The boom control circuit further includes an energy recovery motor, a boom motor generator, and a clutch. The energy recovery motor is provided in a return fluid passage through which return fluid discharged from the boom cylinder flows. The boom motor generator is adapted to be driven by the energy recovery motor so as to function as a generator for feeding electric power to the electric power storage device of the hybrid type drive system as well as be driven by electric power fed from the electric power storage device so as to function as an electric motor. The clutch serves to transmit electric power from the boom motor generator functioning as an electric motor to the boom pump and disengage the boom motor generator functioning as a generator from the boom pump.

Another embodiment of the present invention relates to a work machine having a lower structure adapted to be driven by a travel motor, an upper structure that is rotatable on the lower structure by a swing motor generator, and a work equipment that is mounted on the upper structure and comprises a boom, a stick, and a bucket, wherein the work machine further includes a hybrid type drive system, a hydraulic actuator control circuit, and a swing control circuit. The boom, the stick, and the bucket of the work equipment are sequentially connected and adapted to be pivoted by a boom cylinder, a stick cylinder and a bucket cylinder respectively. The hybrid type drive system comprises an engine, a motor generator, an electric power storage device, and a main pump. The motor generator is adapted to be driven by the engine so as to function as a generator as well as receive electric power so as to function as an electric motor. The electric power storage device serves to store electric power fed from the motor generator functioning as a generator, as well as feed electric power to the motor generator functioning as an electric motor. The main pump is adapted to be driven either one of or both the engine and the motor generator. The hydraulic actuator control circuit serves to control hydraulic fluid fed from the main pump of the hybrid type drive system to the travel motor, the boom cylinder, the stick cylinder, and the bucket cylinder. The swing control circuit serves to feed electric power from the electric power storage device of the hybrid type drive system to the aforementioned swing motor generator so that the swing motor generator functions as an electric motor. Another function of the swing control circuit is to recover to the electric power storage device electric power generated by the swing motor generator functioning as a generator during braking of rotating motion of the upper structure. The hydraulic actuator control circuit comprises a boom assist pump, an energy recovery motor, and a boom motor generator. The boom assist pump serves to assist flow rate of hydraulic fluid fed from the main pump of the hybrid type drive system to the boom cylinder. The energy recovery motor is provided in a return fluid passage through which return fluid discharged from the boom cylinder flows. The boom motor generator is adapted to be driven by the energy recovery motor so as to function as a generator for feeding electric power to the electric power storage device of the hybrid type drive system as well as be driven by electric power fed from the electric power storage device so as to function as an electric motor.

Another embodiment relates to a work machine discussed above, wherein the energy recovery motor is provided in the return fluid passage that extends from a head-side of the boom cylinder.

A further embodiment of the present invention relates to a work machine as above, wherein the return fluid passage includes a return passage provided with the aforementioned energy recovery motor, another return passage that branches off the upstream side of the energy recovery motor, and a flow rate ratio control valve for controlling a flow rate ratio of a flow rate in the first mentioned return passage and a flow rate in the other return passage.

The present invention also relates to a work machine claimed wherein the hydraulic actuator control circuit further includes a clutch that serves to transmit electric power from the boom motor generator functioning as an electric motor to the boom assist pump and disengage the boom motor generator functioning as a generator from the boom assist pump.

The present invention further relates to a work machine claimed in any of the above embodiments, wherein the work machine includes a plurality of main pumps, and the hydraulic actuator control circuit further includes a boom cylinder hydraulic fluid feeding passage, a bucket cylinder hydraulic fluid feeding passage, a stick cylinder hydraulic fluid feeding passage, a solenoid valve between bucket and boom, a circuit-to-circuit communicating passage between bucket and stick, a solenoid valve between bucket and stick. The boom cylinder hydraulic fluid feeding passage is provided for feeding hydraulic fluid from one of the main pumps to the boom cylinder. The bucket cylinder hydraulic fluid feeding passage branches off the boom cylinder hydraulic fluid feeding passage and serves to feed hydraulic fluid to the bucket cylinder. The stick cylinder hydraulic fluid feeding passage serves to feed hydraulic fluid from another main pump to the stick cylinder. The solenoid valve between bucket and boom is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage. The solenoid valve between bucket and boom is adapted to be moved between a position for enabling the hydraulic fluid that would otherwise be fed to the bucket cylinder to be fed to the boom cylinder in a one-way direction and a position for interrupting the flow of fluid. The circuit-to-circuit communicating passage between bucket and stick provides fluid communication between the bucket cylinder hydraulic fluid feeding passage and the stick cylinder hydraulic fluid feeding passage. The solenoid valve between bucket and stick is disposed in the circuit-to-circuit communicating passage between bucket and stick and adapted to be moved between a position for enabling flow in one direction from the bucket cylinder hydraulic fluid feeding passage to the stick cylinder hydraulic fluid feeding passage and a position for interrupting the flow of fluid.

An embodiment of the present invention relates to a work machine claimed above, wherein the work machine further includes a circuit-to-circuit communicating passage between stick and boom, and a solenoid valve between stick and boom. The circuit-to-circuit communicating passage between stick and boom provides fluid communication between the stick cylinder hydraulic fluid feeding passage and the head-side of the boom cylinder. The solenoid valve between stick and boom is disposed in the circuit-to-circuit communicating passage between stick and boom and adapted to be moved between a position for enabling flow in one direction from the stick cylinder hydraulic fluid feeding passage to the head-side of the boom cylinder and a position for interrupting the flow of fluid.

According to the present invention, the boom control circuit, which includes the boom pump provided separately from the main pump of the hybrid type drive system and serves to control hydraulic fluid fed from the boom pump to the boom cylinder, is adapted to function independently of the travel/stick/bucket control circuit, which serves to control hydraulic fluid fed from the main pump of the hybrid type drive system to the travel motor, the stick cylinder, and the bucket cylinder. Therefore, the flow rate required by the boom cylinder can be easily ensured by, for example, controlling the rotation speed of the boom pump by means of the boom motor generator without being affected by the hydraulic fluid fed to the travel motor, the stick cylinder, or the bucket cylinder. Furthermore, the boom control circuit is capable of disengaging the clutch so that the energy recovery motor driven by return fluid discharged from the boom cylinder efficiently inputs driving power to the boom motor generator, which is under no-load condition, and that the generated electric power is stored in the electric power storage device. The boom control circuit is also capable of engaging the clutch so that electric power fed from the electric power storage device enables the boom motor generator to function as an electric motor to drive the boom pump, thereby feeding hydraulic fluid from the boom pump to the boom cylinder. Thus, energy of return fluid discharged from the boom cylinder can be effectively recovered even in an open circuit.

According to another embodiment of the present invention, when controlling hydraulic fluid fed from the main pump of the hybrid type drive system to the travel motor, the boom cylinder, the stick cylinder, and the bucket cylinder, the hydraulic actuator control circuit enables the energy recovery motor driven by return fluid discharged from the boom cylinder to input driving power to the boom motor generator so that the generated electric power is stored in the electric power storage device of the hybrid type drive system. The hydraulic actuator control circuit also enables the boom motor generator to be driven by electric power fed from the electric power storage device of the hybrid type drive system so that the boom motor generator functions as an electric motor to drive the boom assist pump, thereby feeding hydraulic fluid from the boom assist pump to the boom cylinder. Thus, energy of return fluid discharged from the boom cylinder can be effectively recovered even in an open circuit.

According to a further embodiment of the present invention, when the boom of the work equipment, which is attached to the machine body of the work machine, descends due to its own weight, the energy of the return fluid discharged from the head side of the boom cylinder can be absorbed by the energy recovery motor and the boom motor generator and stored in the electric power storage device.

According to an embodiment of the present invention, the energy recovery motor is provided in one of the return passages through which return fluid discharged from the boom cylinder flows, and the flow rate ratio control valve controls a flow rate ratio of a flow rate of the return fluid passing through the energy recovery motor and a flow rate of the return fluid in the other return passage, which branches off the first mentioned return passage at a location upstream of the energy recovery motor. Therefore, the configuration according to the present invention is capable of gradually increasing the flow rate proportion of the fluid distributed towards the energy recovery motor from the moment when return fluid starts to flow from the boom cylinder, thereby preventing occurrence of shock, as well as ensuring stable function of the boom cylinder by preventing a sudden change in load to the boom cylinder.

According to the present invention disengaging the clutch enables the energy recovery motor, which is driven by return fluid discharged from the boom cylinder, to efficiently input driving power to the boom motor generator, which is under no-load condition, so that the generated electric power is stored in the electric power storage device of the hybrid type drive system. When the clutch is engaged, electric power fed from the electric power storage device of the hybrid type drive system enables the boom motor generator to function as an electric motor to drive the boom assist pump, thereby feeding hydraulic fluid from the boom assist pump to the boom cylinder.

According to another embodiment of the present invention, the solenoid valve between bucket and boom is disposed in the boom cylinder hydraulic fluid feeding passage. Therefore, by opening this solenoid valve, a combined amount of hydraulic fluid can be fed from one of the main pumps and the boom assist pump to the boom cylinder. Therefore, it is possible to increase the speed of boom raising action by the boom cylinder and improve working efficiency. Furthermore, a high pressure to the bucket cylinder can be ensured by closing the solenoid valve. As the solenoid valve between bucket and stick is disposed in the circuit-to-circuit communicating passage between bucket and stick, opening this solenoid valve ensures supply of hydraulic fluid from another main pump to the stick cylinder, thereby increasing the speed of action of the stick cylinder and improving working efficiency. Furthermore, a high pressure to the bucket cylinder can be ensured by closing the solenoid valve.

According to the present invention, the solenoid valve between stick and boom is disposed in the circuit-to-circuit communicating passage between stick and boom for providing fluid communication between the stick cylinder hydraulic fluid feeding passage and the head-side of the boom cylinder. Therefore, by opening this solenoid valve, hydraulic fluid can be fed to the head-side of the boom cylinder not only from the first-mentioned main pump and the boom assist pump but also from the second-mentioned main pump, thereby increasing the speed of boom raising action by the boom cylinder and improving working efficiency. Furthermore, supply of hydraulic fluid to the stick cylinder can be ensured by closing the solenoid valve.

DETAILED DESCRIPTION OF THE INVENTION

Figure 1:
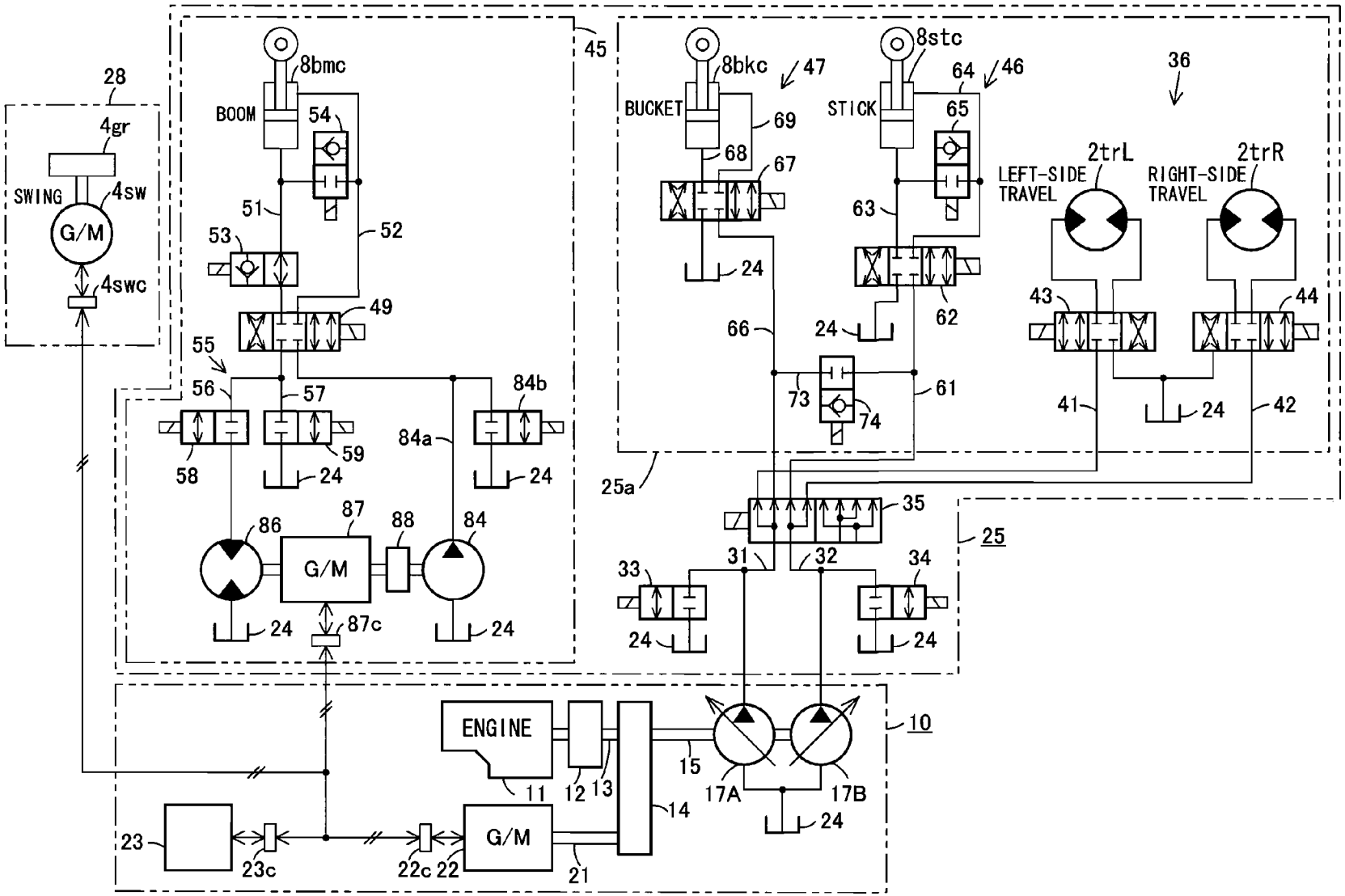
FIG. 1 is a circuit diagram showing a hybrid type drive system and a hydraulic actuator control circuit of a work machine according to an embodiment of the present invention.
Figure 2:
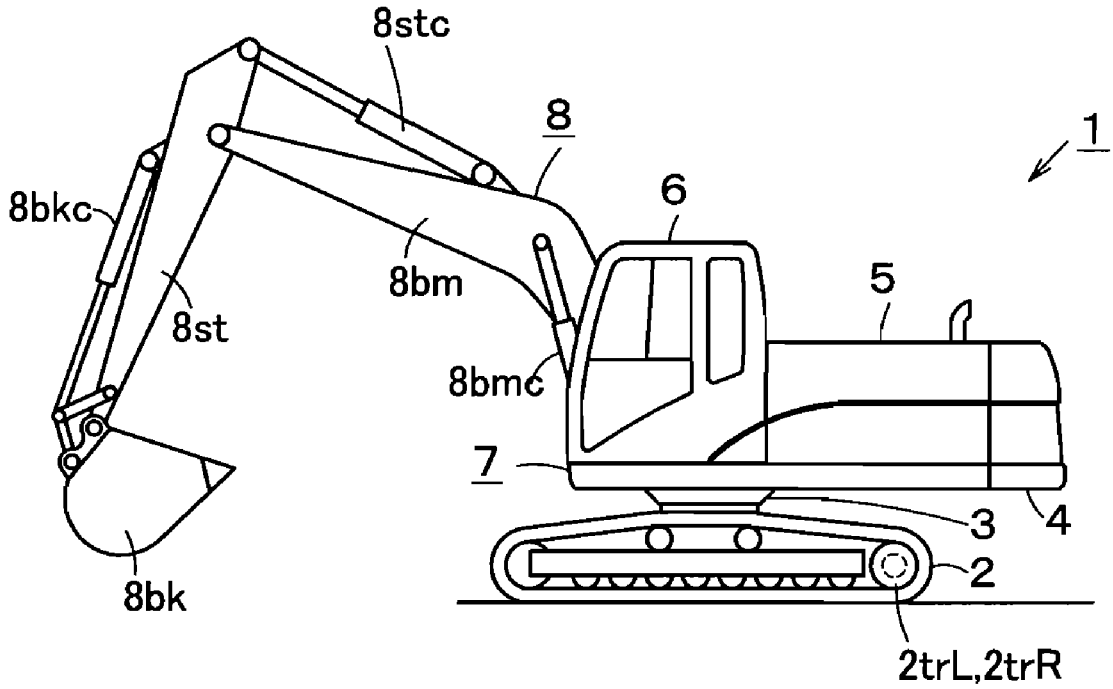
FIG. 2 is a side view of the aforementioned work machine.
Figure 3:
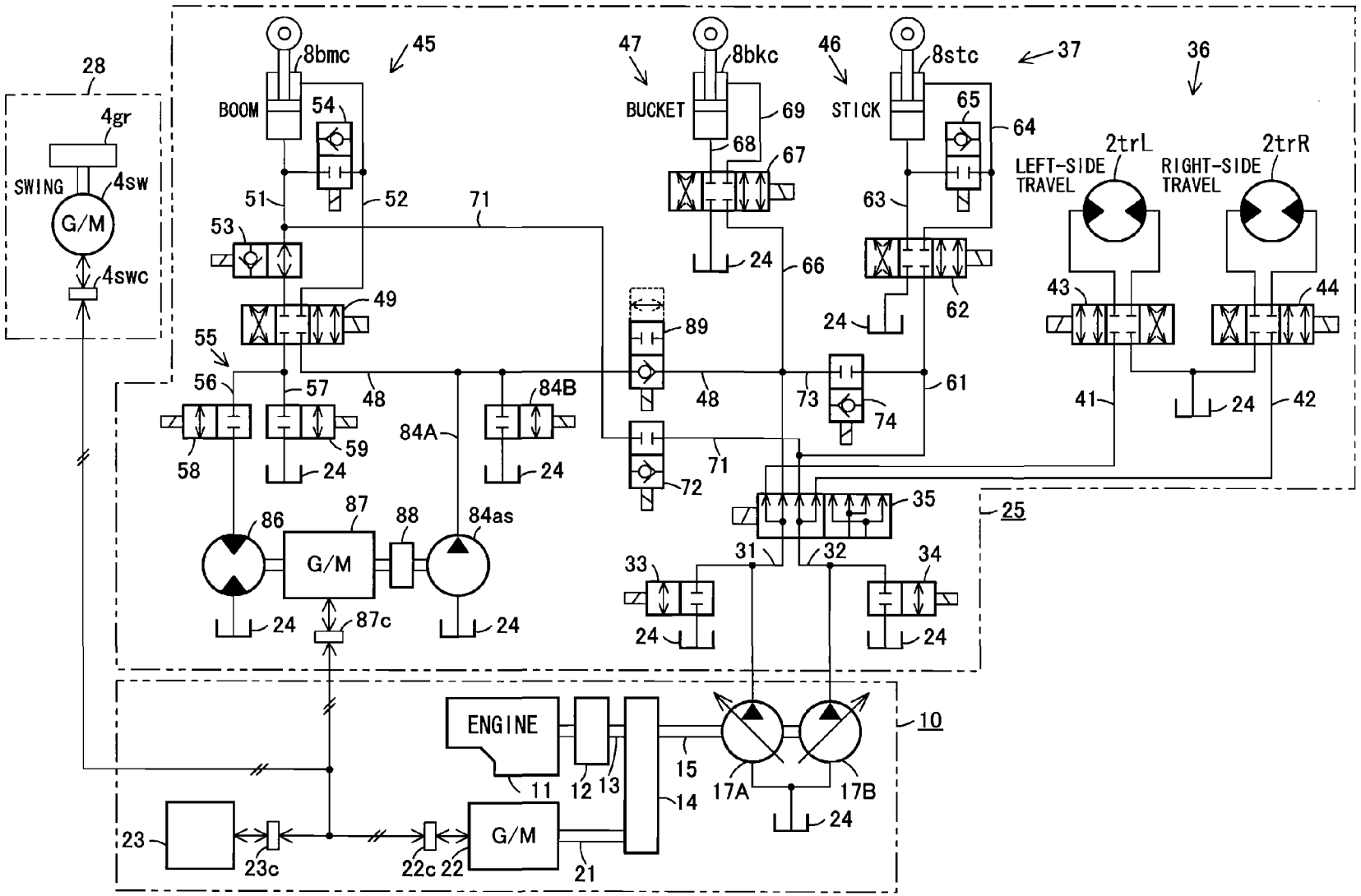
FIG. 3 is a circuit diagram showing a hybrid type drive system and a hydraulic actuator control circuit of a work machine according to another embodiment of the present invention.

Next, the present invention is explained in detail hereunder, referring to an embodiment thereof shown in FIGS. 1 and 2 and another embodiment shown in FIG. 3. The fluid and fluid pressure used in those embodiments are hydraulic oil and oil pressure, respectively.

First, the embodiment shown in FIGS. 1 and 2 is explained. As shown in FIG. 2, a work machine 1 is a hydraulic excavator that includes a machine body 7. The machine body 7 is comprised of a lower structure 2, an upper structure 4 rotatably mounted on the lower structure 2 with a swing bearing portion 3 therebetween, and components mounted on the upper structure 4. The components mounted on the upper structure 4 include a power unit 5 comprised of an engine, hydraulic pumps, etc., and a cab 6 for protecting an operator. The lower structure 2 is provided with travel motors 2*tr*L, 2*tr*R for respectively driving right and left crawler belts. The upper structure 4 is provided with a swing motor generator (not shown in FIG. 2) for driving a swing deceleration mechanism provided in the swing bearing portion 3.

A work equipment 8 is attached to the upper structure 4. The work equipment 8 comprises a boom 8*bm*, a stick 8*st*, and a bucket 8*bk* that are connected sequentially as well as pivotally by means of pins, wherein the boom 8*bm* is attached to a bracket (not shown) of the upper structure 4 by means of pins. The boom 8*bm*, the stick 8*st*, and the bucket 8*bk* can be pivoted by means of a boom cylinder 8*bmc*, a stick cylinder 8*stc*, and a bucket cylinder 8*bkc*, respectively.

A hybrid type drive system 10 shown in FIG. 1 comprises an engine 11, a clutch 12, a power transmission unit 14, and two main pumps 17A,17B of a variable delivery type. The clutch 12 is connected to the engine 11 and serves to transmit or interrupt rotational power output from the engine 11. An input axis 13 of the power transmission unit 14 is connected to the clutch 12, and an output axis 15 of the power transmission unit 14 is connected to the main pumps 17A,17B.

A motor generator 22 is connected to an input/output axis 21 of the power transmission unit 14 so that the motor generator 22 is arranged in parallel with the engine 11 with respect to the main pumps 17A,17B. The motor generator 22 is adapted to be driven by the engine 11 so as to function as a generator as well as receive electric power so as to function as an electric motor. The motor power of the motor generator 22 is set to be smaller than the engine power. A motor generator controller 22*c*, which may be an inverter or the like, is connected to the motor generator 22.

An electric power storage device 23, which may be a battery, a capacitor, or the like, is connected to the motor generator 22*c* through an electric power storage device controller 23*c*, which may be a converter or the like. The electric power storage device 23 serves to store electric power fed from the motor generator 22 functioning as a generator, as well as feed electric power to the motor generator 22 functioning as a motor.

The power transmission unit 14 of the hybrid type drive system 10 incorporates a continuously variable transmission mechanism, such as a toroidal type, a planetary gear type, etc., so that, upon receiving a control signal from outside, the power transmission unit 14 is capable of outputting rotation of continuously varying speed to its output axis 15.

The main pumps 17A,17B of the hybrid type drive system 10 serve to feed hydraulic fluid, such as hydraulic oil, that is contained in a tank 24 to a travel/stick/bucket control circuit 25*a* of a hydraulic actuator control circuit 25. The hydraulic actuator control circuit 25 serves to control various hydraulic actuators of the work machine 1. The travel/stick/bucket control circuit 25*a* serves to control hydraulic fluid fed to the travel motors 2*tr*L,2*tr*R, the stick cylinder 8*stc*, and the bucket cylinder 8*bkc*.

The hydraulic actuator control circuit 25 includes a boom control circuit 45, which is provided separately and independently from the travel/stick/bucket control circuit 25*a* and serves to control hydraulic fluid fed to the boom cylinder 8*bmc*.

A swing control circuit 28 is provided separately and independently from the travel/stick/bucket control circuit 25*a* and the boom control circuit 45. The swing control circuit 28 serves to feed electric power from the electric power storage device 23 of the hybrid type drive system 10 to the aforementioned swing motor generator 4*sw* so that the swing motor generator 4*sw* functions as an electric motor. Another function of the swing control circuit 28 is to recover to the electric power storage device 23 electric power generated by the swing motor generator 4*sw* functioning as a generator during braking of rotating motion of the upper structure 4.

The swing control circuit 28 includes the aforementioned swing motor generator 4*sw* and a swing motor generator controller 4*swc*, which may be an inverter or the like. The swing motor generator 4*sw* serves to rotate the upper structure 4 through a swing deceleration mechanism 4*gr*. The swing motor generator 4*sw* is adapted to be driven by electric power fed from the electric power storage device 23 of the hybrid type drive system 10 so as to function as an electric motor. The swing motor generator 4*sw* is also adapted to function as a generator when being rotated by inertial rotation force so as to recover electric power to the electric power storage device 23.

Pump passages 31,32 are respectively connected to output ports of the main pumps 17A,17B of the hybrid type drive system 10. The pump passages 31,32 are also respectively connected to solenoid valves 33,34, which serve as proportional solenoid valves, as well as to a solenoid valve 35, which is adapted to function as a straight travel valve. The solenoid valves 33,34 are respectively disposed in bypass passages for returning hydraulic fluid to the tank 24.

Each solenoid valve 33,34 may function as a bypass valve. To be more specific, when there is no operating signal that signifies the operator operating any one of the corresponding hydraulic actuators 2*tr*L,2*tr*R,8*stc*,8*bkc*, a control signal from the controller controls the valve to a fully open position so that the corresponding pump passage 31,32 communicates with the tank 24. When the operator operates any hydraulic actuator 2*tr*L,2*tr*R,8*stc*,8*bkc*, the corresponding solenoid valve 33,34 moves to a closed position in proportion to the magnitude of the operating signal.

When at the left position as viewed in FIG. 1, the solenoid valve 35 enables hydraulic fluid to be fed from the two main pumps 17A,17B to the hydraulic actuators 2*tr*L,2*tr*R, 8*stc*, 8*bkc*. When the solenoid valve 35 is switched to the right position, i.e. the straight travel position, it permits one of the main pumps, i.e. the main pump 17B, to feed equally divided volume of hydraulic fluid to the two travel motors 2*tr*L,2*tr*R, thereby enabling the work machine 1 to travel straight.

The travel/stick/bucket control circuit 25*a* includes a travel control circuit 36, a stick control circuit 46, and a bucket control circuit 47. The travel control circuit 36 serves to control hydraulic fluid fed from the main pumps 17A,17B of the hybrid type drive system 10 to the travel motors 2*tr*L,2*tr*R. The stick control circuit 46 serves to control hydraulic fluid fed from the main pumps 17A,17B of the hybrid type drive system 10 to the stick cylinder 8*stc*, which serves to operate the work equipment 8. The bucket control circuit 47 serves to control hydraulic fluid fed from the main pumps 17A,17B of the hybrid type drive system 10 to the bucket cylinder 8*bkc*.

The travel control circuit 36 includes solenoid valves 43,44 for controlling direction and flow rate of hydraulic fluid supplied respectively through travel motor hydraulic fluid feeding passages 41,42. The travel motor hydraulic fluid feeding passages 41,42 are drawn from the solenoid valve 35, which functions as a straight travel valve.

The boom control circuit 45 includes a boom pump 84 and a solenoid valve 49. The boom pump 84 is provided separately from the main pumps 17A,17B of the hybrid type drive system 10. The solenoid valve 49 serves to control direction and flow rate of hydraulic fluid fed from the boom pump 84 through a boom cylinder hydraulic fluid feeding passage 84*a* to the boom cylinder 8*bmc*. The solenoid valve 49 is provided with hydraulic fluid feed/discharge passages 51,52, which respectively communicate with the head-side chamber and the rod-side chamber of the boom cylinder 8*bmc*. A solenoid valve 84*b* that functions in a similar manner to the aforementioned solenoid valves 33,34 is disposed in a bypass passage for returning hydraulic fluid from the boom cylinder hydraulic fluid feeding passage 84*a* to the tank 24.

A solenoid valve 53 that serves as a fall preventive valve is included in the head-side hydraulic fluid feed/discharge passage 51 so that when movement of the boom 8*bm* is stopped, the boom 8*bm* is prevented from descending due to its own weight by switching the solenoid valve 53 to a check valve position at the left side, at which the solenoid valve 53 functions as a check valve. A solenoid valve 54 that serves as a regeneration valve is disposed between the two hydraulic fluid feed/discharge passages 51,52 so that a part of return fluid discharged from the head-side chamber of the boom cylinder 8*bmc* can be regenerated into the rod-side chamber by switching the solenoid valve 54 to the check valve position when the boom is lowered.

A return fluid passage 55 that permits the fluid discharged from the boom cylinder 8*bmc* to branch off is provided at the tank passage side of the solenoid valve 49. The return fluid passage 55 comprises two return passages 56,57, which are provided with a flow rate ratio control valve 58,59 for controlling a ratio of fluid that branches off into the return passages 56,57. The flow rate ratio control valve 58,59 is comprised of two flow control solenoid valves: a solenoid valve 58 disposed in the return passage 56, and a solenoid valve 59 disposed in the return passage 57, which branches off the upstream side of the solenoid valve 58.

An energy recovery motor 86 is provided in the return passage 56, through which return fluid discharged from the boom cylinder 8*bmc* flows. A boom motor generator 87 is connected to the energy recovery motor 86. The boom motor generator 87 is adapted to be driven by the energy recovery motor 86 so as to function as a generator for feeding electric power to the electric power storage device 23 of the hybrid type drive system 10 as well as driven by electric power fed from the electric power storage device 23 so as to function as an electric motor. The aforementioned boom pump 84 is connected to the boom motor generator 87 through a clutch 88, which is controlled so as to transmit electric power from the boom motor generator 87 to the boom pump 84 when the boom motor generator 87 functions as an electric motor, and, when the boom motor generator 87 functions as a generator, disengage the boom motor generator 87 from the boom pump 84.

When the energy recovery motor 86 is in operation, its rotation speed is controlled by the flow rate of return fluid in the return passage 56, the aforementioned flow rate being controlled by the flow rate ratio control valve 58,59. By means of a motor generator controller 87*c* of the boom motor generator 87, electric power is recovered from the boom motor generator 87, which is driven by this energy recovery motor 86, and fed to the electric power storage device 23 of the hybrid type drive system 10 and stored therein.

It is desirable for the energy recovery motor 86 to function when the solenoid valve 49, which is provided for controlling direction and flow rate of hydraulic fluid, is positioned at the right chamber position as viewed in FIG. 1. In other words, it is desirable that when the boom is lowered, the hydraulic fluid feed/discharge passage 51 at the head-side of the boom cylinder 8*bmc* communicate with the return fluid passage 55 so as to permit the return fluid discharged from the head-side of the boom cylinder 8*bmc* to drive the energy recovery motor 86 well within its capacity because of the dead weight of the boom.

The stick control circuit 46 includes a solenoid valve 62 for controlling direction and flow rate of hydraulic fluid supplied through a stick cylinder hydraulic fluid feeding passage 61. The stick cylinder hydraulic fluid feeding passage 61 is drawn from the solenoid valve 35, which functions as a straight travel valve. The solenoid valve 62 is provided with hydraulic fluid feed/discharge passages 63,64, which respectively communicate with the head-side chamber and the rod-side chamber of the stick cylinder 8*stc*. A solenoid valve 65 that serves as a regeneration valve for returning fluid from the rod side to the head side is disposed between the two hydraulic fluid feed/discharge passages 63,64 so that return fluid discharged from the rod-side chamber of the stick cylinder 8*stc* can be regenerated into the head-side chamber by switching the solenoid valve 65 to the check valve position when the stick is lowered by stick-in operation.

The bucket control circuit 47 includes a solenoid valve 67 for controlling direction and flow rate of hydraulic fluid supplied through a bucket cylinder hydraulic fluid feeding passage 66. The bucket cylinder hydraulic fluid feeding passage 66 is drawn from the solenoid valve 35, which functions as a straight travel valve. The solenoid valve 67 is provided with hydraulic fluid feed/discharge passages 68,69, which respectively communicate with the head-side chamber and the rod-side chamber of the bucket cylinder 8*bkc*.

A circuit-to-circuit communicating passage 73 between bucket and stick is disposed between the bucket cylinder hydraulic fluid feeding passage 66 and the stick cylinder hydraulic fluid feeding passage 61 and thereby provides fluid communication between them. A solenoid valve 74 between bucket and stick is disposed in the circuit-to-circuit communicating passage 73 between bucket and stick. The solenoid valve 74 is adapted to be moved between a position for enabling flow in one direction from the bucket cylinder hydraulic fluid feeding passage 66 to the stick cylinder hydraulic fluid feeding passage 61 and a position for interrupting the flow of fluid.

Speed of the engine 11, engagement/disengagement by the clutch 12, speed change by the power transmission unit 14, and engagement/disengagement by the clutch 88 are controlled based on signals output from the controller (not shown).

Each one of the solenoid valves 53,54,65,74 is a selector valve that incorporates a check valve and is capable of controlling flow rate.

Each one of the solenoid valves 33,34,35,43,44,49,53,54,58,59,62,65,67,74,84*b* has a return spring (not shown) and a solenoid that is adapted to be proportionally controlled by the controller (not shown) so that each solenoid valve is controlled to a position to achieve a balance between excitation force of the solenoid and restorative force of the spring.

Next, the operations and effects of the embodiment shown in FIGS. 1 and 2 are explained hereunder.

The boom control circuit 45, which includes the boom pump 84 provided separately from the main pumps 17A,17B of the hybrid type drive system 10 and serves to control hydraulic fluid fed from the boom pump 84 to the boom cylinder 8*bmc*, is adapted to function independently of the travel/stick/bucket control circuit 25*a*, which serves to control hydraulic fluid fed from the main pumps 17A,17B of the hybrid type drive system 10 to the travel motors 2*tr*L,2*tr*R, the stick cylinder 8*stc*, and the bucket cylinder 8*bkc*. Therefore, the flow rate required by the boom cylinder 8*bmc* can be easily ensured by, for example, controlling the rotation speed of the boom pump 84 by means of the boom motor generator 87 without being affected by the hydraulic fluid fed to the travel motors 2*tr*L,2*tr*R, the stick cylinder 8*stc*, or the bucket cylinder 8*bkc*.

The boom control circuit 45 drives the energy recovery motor 86 by means of the return fluid discharged from the boom cylinder 8*bmc* so that the energy recovery motor 86 drives the boom motor generator 87 to feed electric power to the electric power storage device 23 of the hybrid type drive system 10. Therefore, the boom control circuit 45 enables the energy of the return fluid discharged from the boom cylinder 8*bmc* to be efficiently recovered to the electric power storage device 23 so that the energy can be effectively regenerated as pump power for the hybrid type drive system 10.

The configuration described above is particularly beneficial when the boom 8*bm* of the work equipment 8, which is attached to the machine body 7 of the work machine 1, descends due to its own weight, because the energy of the return fluid discharged from the head side of the boom cylinder 8*bmc* is absorbed by the energy recovery motor 86 and the boom motor generator 87 and stored in the electric power storage device 23.

At that time, the boom control circuit 45 disengages the clutch 88 so that the energy recovery motor 86 driven by return fluid discharged from the boom cylinder 8*bmc* efficiently inputs driving power to the boom motor generator 87, which is under no-load condition, and that the generated electric power is stored in the electric power storage device 23 of the hybrid type drive system 10.

When the clutch 88 is engaged, electric power fed from the electric power storage device 23 enables the boom motor generator 87 to function as an electric motor to drive the boom pump 84 so that hydraulic fluid is fed from the boom pump 84 to the boom cylinder 8*bmc*. Thus, energy of return fluid discharged from the boom cylinder 8*bmc* can be effectively recovered even in an open circuit.

The flow rate of hydraulic fluid fed to the boom cylinder 8*bmc* at that time is determined by the pump capacity and rotation speed of the boom pump 84, which is dedicated to the boom circuit. The pump capacity of the boom pump 84 depends on the main pumps 17A,17B, whereas the rotation speed of the boom pump 84 is controlled by the boom motor generator 87. Supply of a sufficient amount of hydraulic fluid to the head-side of the boom cylinder 8*bmc* is ensured, resulting in more efficient boom raising action.

At the return fluid passage 55, the boom control circuit 45 divides the return fluid discharged from the boom cylinder 8*bmc*, controls the proportion of divided flows of the fluid by the flow rate ratio control valve 58,59, and, by means of the return fluid in one of the divided flows, whose flow rate is controlled by the flow rate ratio control valve 58,59, drives the energy recovery motor 86. With the configuration as above, the boom control circuit 45 is capable of gradually increasing the flow rate proportion of the fluid distributed towards the energy recovery motor 86 from the moment when return fluid starts to flow from the boom cylinder 8*bmc*, thereby preventing occurrence of shock, as well as ensuring stable function of the boom cylinder 8*bmc* by preventing a sudden change in load to the boom cylinder 8*bmc*.

In other words, when the boom 8*bm* of the work equipment 8 descends due to its own weight, gradual increase of the flow rate proportion of the return fluid distributed from the head side of the boom cylinder 8*bmc* towards the energy recovery motor 86 enables the energy recovery motor 86 to smoothly absorb the energy of the return fluid, and the prevention of a sudden change in load to the boom cylinder 8*bmc* stabilizes the descending action of the boom 8*bm* due to its own weight. In short, energy generated during descent of the boom can be stored independent of other circuits.

The solenoid valve 58 and the solenoid valve 59 of the flow rate ratio control valve 58,59 may each be disposed at desired, separate locations in the return passage 56 and the return passage 57 respectively. Furthermore, the flow rate ratio control valve 58,59 is capable of controlling return fluid flowing towards the energy recovery motor 86 at a desired flow rate and flow rate ratio by controlling an aperture of each respective return passage 56,57 separately and independently of each other.

When stopping the upper structure 4, which is being rotated on the lower structure 2 by the swing motor generator 4*sw* functioning as an electric motor, the swing control circuit 28 operates the swing motor generator 4*sw* to function as a generator. Thus, the rotation of the upper structure 4 can be braked, while the electric power generated by the swing motor generator 4*sw*, together with the electric power generated by the boom motor generator 87 driven by the energy recovery motor 86, can be efficiently recovered to the electric power storage device 23 of the hybrid type drive system 10 and effectively regenerated as pump power for the hybrid type drive system 10.

Furthermore, controlling the solenoid valve 74 between bucket and stick at the aforementioned position for enabling flow in one direction enables hydraulic fluid that would otherwise be fed from the main pump 17A, which may also be referred to as a first main pump, to the bucket cylinder 8*bkc* to merge with the hydraulic fluid fed from the main pump 17B, which may also be referred to as a second main pump, to the stick cylinder 8*stc*, thereby increasing the speed of the stick cylinder 8*stc*. Furthermore, controlling the solenoid valve 74 between bucket and stick at the flow interruption position enables the bucket control circuit 47 and the stick control circuit 46 to function independently of each other, thereby separating the bucket system and the stick system so that pressures in the two systems can be controlled independently of each other.

Next, the embodiment shown in FIG. 3 is explained. As the work machine of this embodiment is the same as the one shown in FIG. 2, its explanation is omitted hereunder.

A hybrid type drive system 10 shown in FIG. 3 comprises an engine 11, a clutch 12, a power transmission unit 14, and two main pumps 17A,17B of a variable delivery type. The clutch 12 is connected to the engine 11 and serves to transmit or interrupt rotational power output from the engine 11. An input axis 13 of the power transmission unit 14 is connected to the clutch 12, and an output axis 15 of the power transmission unit 14 is connected to the main pumps 17A,17B.

A motor generator 22 is connected to an input/output axis 21 of the power transmission unit 14 so that the motor generator 22 is arranged in parallel with the engine 11 with respect to the main pumps 17A,17B. The motor generator 22 is adapted to be driven by the engine 11 so as to function as a generator as well as receive electric power so as to function as an electric motor. The motor power of the motor generator 22 is set to be smaller than the engine power. A motor generator controller 22*c*, which may be an inverter or the like, is connected to the motor generator 22.

An electric power storage device 23, which may be a battery, a capacitor, or the like, is connected to the motor generator 22*c* through an electric power storage device controller 23*c*, which may be a converter or the like. The electric power storage device 23 serves to store electric power fed from the motor generator 22 functioning as a generator, as well as feed electric power to the motor generator 22 functioning as a motor.

The power transmission unit 14 of the hybrid type drive system 10 incorporates a continuously variable transmission mechanism, such as a toroidal type, a planetary gear type, etc., so that, upon receiving a control signal from outside, the power transmission unit 14 is capable of outputting rotation of continuously varying speed to its output axis 15.

The main pumps 17A,17B of the hybrid type drive system 10 serve to feed hydraulic fluid, such as hydraulic oil, that is contained in a tank 24 to a hydraulic actuator control circuit 25. The hydraulic actuator control circuit 25 includes an energy recovery motor 86 so that when the energy recovery motor 86 drives a boom motor generator 87, electric power recovered by a generator controller 87*c* of the boom motor generator 87 is stored in the electric power storage device 23.

A swing control circuit 28 is provided separately and independently from the hydraulic actuator control circuit 25. The swing control circuit 28 serves to feed electric power from the electric power storage device 23 of the hybrid type drive system 10 to a swing motor generator 4*sw* so that the swing motor generator 4*sw* functions as an electric motor. Another function of the swing control circuit 28 is to recover to the electric power storage device 23 electric power generated by the swing motor generator 4*sw* functioning as a generator during braking of rotating motion of the upper structure 4.

The swing control circuit 28 includes the aforementioned swing motor generator 4*sw* and a swing motor generator controller 4*swc*, which may be an inverter or the like. The swing motor generator 4*sw* serves to rotate the upper structure 4 through a swing deceleration mechanism 4*gr*. The swing motor generator 4*sw* is adapted to be driven by electric power fed from the electric power storage device 23 of the hybrid type drive system 10 so as to function as an electric motor. The swing motor generator 4*sw* is also adapted to function as a generator when being rotated by inertial rotation force so as to recover electric power to the electric power storage device 23.

Speed of the engine 11, engagement/disengagement by the clutch 12, and speed change by the power transmission unit 14 are controlled based on signals output from a controller (not shown).

The hydraulic actuator control circuit 25 shown in FIG. 3 includes pump passages 31,32, which are respectively connected to output ports of the main pumps 17A,17B. The pump passages 31,32 are also respectively connected to solenoid valves 33,34, which serve as proportional solenoid valves, as well as to a solenoid valve 35, which is adapted to function as a straight travel valve. The solenoid valves 33,34 are respectively disposed in bypass passages for returning hydraulic fluid to the tank 24.

Each solenoid valve 33,34 may function as a bypass valve. To be more specific, when there is no operating signal that signifies the operator operating any one of the corresponding hydraulic actuators 2*tr*L,2*tr*R,8*bmc*,8*stc*,8*bkc*, a control signal from the controller controls the valve to a fully open position so that the corresponding pump passage 31,32 communicates with the tank 24. When the operator operates any hydraulic actuator 2*tr*L,2*tr*R,8*bmc*,8*stc*,8*bkc*, the corresponding solenoid valve 33,34 moves to a closed position in proportion to the magnitude of the operating signal.

When at the left position as viewed in FIG. 3, the solenoid valve 35 enables hydraulic fluid to be fed from the two main pumps 17A,17B to the hydraulic actuators 2*tr*L,2*tr*R,8*bmc*, 8*stc*,8*bkc*. When the solenoid valve 35 is switched to the right position, i.e. the straight travel position, it permits one of the main pumps, i.e. the main pump 17B, which may also be referred to as the second main pump, to feed equally divided volume of hydraulic fluid to the two travel motors 2*tr*L,2*tr*R, thereby enabling the work machine 1 to travel straight.

The hydraulic actuator control circuit 25 includes a travel control circuit 36 and a work equipment control circuit 37. The travel control circuit 36 serves to control hydraulic fluid fed from the main pumps 17A,17B of the hybrid type drive system 10 to the travel motors 2*tr*L,2*tr*R. The work equipment control circuit 37 serves to control hydraulic fluid fed from the main pumps 17A,17B of the hybrid type drive system 10 to the hydraulic actuators 8*bmc*,8*stc*,8*bkc*, which serve to operate the work equipment 8.

The travel control circuit 36 includes solenoid valves 43,44 for controlling direction and flow rate of hydraulic fluid supplied respectively through travel motor hydraulic fluid feeding passages 41,42. The travel motor hydraulic fluid feeding passages 41,42 are drawn from the solenoid valve 35, which functions as a straight travel valve.

The work equipment control circuit 37 includes a boom control circuit 45, a stick control circuit 46, and a bucket control circuit 47. The boom control circuit 45 serves to control hydraulic fluid fed from the main pumps 17A,17B of the hybrid type drive system 10 to the boom cylinder 8*bmc*. The stick control circuit 46 serves to control hydraulic fluid fed from the main pumps 17A,17B of the hybrid type drive system 10 to the stick cylinder 8*stc*. The bucket control circuit 47 serves to control hydraulic fluid fed from the main pumps 17A,17B of the hybrid type drive system 10 to the bucket cylinder 8*bkc*.

The boom control circuit 45 includes a solenoid valve 49 for controlling direction and flow rate of hydraulic fluid supplied through a boom cylinder hydraulic fluid feeding passage 48. The boom cylinder hydraulic fluid feeding passage 48 is drawn from the solenoid valve 35, which functions as a straight travel valve. The solenoid valve 49 is provided with hydraulic fluid feed/discharge passages 51,52, which respectively communicate with the head-side chamber and the rod-side chamber of the boom cylinder 8*bmc*.

A solenoid valve 53 that serves as a fall preventive valve is included in the head-side hydraulic fluid feed/discharge passage 51 so that when movement of the boom 8*bm* is stopped, the boom 8*bm* is prevented from descending due to its own weight by switching the solenoid valve 53 to a check valve position at the left side, at which the solenoid valve 53 functions as a check valve. A solenoid valve 54 that serves as a regeneration valve is disposed between the two hydraulic fluid feed/discharge passages 51,52 so that a part of return fluid discharged from the head-side chamber of the boom cylinder 8*bmc* can be regenerated into the rod-side chamber by switching the solenoid valve 54 to the check valve position when the boom is lowered.

A return fluid passage 55 that permits the fluid discharged from the boom cylinder 8*bmc* to branch off is provided at the tank passage side of the solenoid valve 49. The return fluid passage 55 comprises two return passages 56,57, which are provided with a flow rate ratio control valve 58,59 for controlling a ratio of fluid that branches off into the return passages 56,57. The flow rate ratio control valve 58,59 is comprised of two flow control solenoid valves: a solenoid valve 58 disposed in the return passage 56, which is provided with the aforementioned energy recovery motor 86, and a solenoid valve 59 disposed in the return passage 57, which branches off the upstream side of the solenoid valve 58.

A boom assist pump 84*as* for assisting flow rate of hydraulic fluid is connected through a boom assist hydraulic fluid feeding passage 84A to the aforementioned boom cylinder hydraulic fluid feeding passage 48, which serves to feed hydraulic fluid from the main pumps 17A,17B of the hybrid type drive system 10 to the boom cylinder 8*bmc*. A solenoid valve 84B that is disposed in a bypass passage and functions in a similar manner to the aforementioned solenoid valves 33,34 is also connected to the boom cylinder hydraulic fluid feeding passage 48.

The aforementioned boom motor generator 87 is connected to the energy recovery motor 86 provided in the return passage 56, through which return fluid discharged from the boom cylinder 8*bmc* flows. The boom motor generator 87 is adapted to be driven by the energy recovery motor 86 so as to function as a generator for feeding electric power to the electric power storage device 23 of the hybrid type drive system 10 as well as driven by electric power fed from the electric power storage device 23 so as to function as an electric motor. The boom motor generator 87 is connected through a clutch 88 to the boom assist pump 84 as. The clutch 88 serves to transmit electric power from the boom motor generator 87 to the boom assist pump 84*as* when the boom motor generator 87 functions as an electric motor. When the boom motor generator 87 functions as a generator, the clutch 88 serves to disengage the boom motor generator 87 from the boom assist pump 84*as*.

When the energy recovery motor 86 is in operation, its rotation speed is controlled by the flow rate of return fluid in the return passage 56, the aforementioned flow rate being controlled by the flow rate ratio control valve 58,59, so that electric power is fed from the boom motor generator 87, which is driven by this energy recovery motor 86, to the electric power storage device 23 of the hybrid type drive system 10 and stored therein.

It is desirable for the energy recovery motor 86 to function when the solenoid valve 49, which is provided for controlling direction and flow rate of hydraulic fluid, is positioned at the right chamber position as viewed in FIG. 3. In other words, it is desirable that when the boom is lowered, the hydraulic fluid feed/discharge passage 51 at the head-side of the boom cylinder 8*bmc* communicate with the return fluid passage 55 so as to permit the return fluid discharged from the head-side of the boom cylinder 8*bmc* to drive the energy recovery motor 86 well within its capacity because of the dead weight of the boom.

The stick control circuit 46 includes a solenoid valve 62 for controlling direction and flow rate of hydraulic fluid supplied through a stick cylinder hydraulic fluid feeding passage 61. The stick cylinder hydraulic fluid feeding passage 61 is drawn from the solenoid valve 35, which functions as a straight travel valve. The solenoid valve 62 is provided with hydraulic fluid feed/discharge passages 63,64, which respectively communicate with the head-side chamber and the rod-side chamber of the stick cylinder 8*stc*. A solenoid valve 65 that serves as a regeneration valve for returning fluid from the rod side to the head side is disposed between the two hydraulic fluid feed/discharge passages 63,64 so that return fluid discharged from the rod-side chamber of the stick cylinder 8*stc* can be regenerated into the head-side chamber by switching the solenoid valve 65 to the check valve position when the stick is lowered by stick-in operation.

The bucket control circuit 47 includes a solenoid valve 67 for controlling direction and flow rate of hydraulic fluid supplied through a bucket cylinder hydraulic fluid feeding passage 66. The bucket cylinder hydraulic fluid feeding passage 66 is drawn from the solenoid valve 35, which functions as a straight travel valve. The solenoid valve 67 is provided with hydraulic fluid feed/discharge passages 68,69, which respectively communicate with the head-side chamber and the rod-side chamber of the bucket cylinder 8*bkc*.

A circuit-to-circuit communicating passage 71 between stick and boom is disposed between the stick cylinder hydraulic fluid feeding passage 61 and the head-side of the boom cylinder 8*bmc* and thereby provides fluid communication between them. A solenoid valve 72 between stick and boom is disposed in the circuit-to-circuit communicating passage 71 between stick and boom. The solenoid valve 72 is adapted to be moved between a position for enabling flow in one direction from the stick cylinder hydraulic fluid feeding passage 61 to the head-side of the boom cylinder 8*bmc* and a position for interrupting the flow of fluid.

A circuit-to-circuit communicating passage 73 between bucket and stick is disposed between the boom cylinder hydraulic fluid feeding passage 48 and the stick cylinder hydraulic fluid feeding passage 61 and thereby provides fluid communication between them. A solenoid valve 74 between bucket and stick is disposed in the circuit-to-circuit communicating passage 73 between bucket and stick. The solenoid valve 74 is adapted to be moved between a position for enabling flow in one direction from the boom cylinder hydraulic fluid feeding passage 48 to the stick cylinder 8*stc* and a position for interrupting the flow of fluid.

A solenoid valve 89 between bucket and boom is disposed in the boom cylinder hydraulic fluid feeding passage 48, at a location between the branching point of the bucket cylinder hydraulic fluid feeding passage 66 and the joining point of the passage from the boom assist pump 84*as*. The solenoid valve 89 between bucket and boom is adapted to be switched between a position for enabling the hydraulic fluid that would otherwise be fed to the bucket cylinder 8*bkc* to be fed to the boom cylinder 8*bmc* in a one-way direction and a position for interrupting the flow of fluid.

Each one of the solenoid valves 53,54,65,72,74,89 is a selector valve that incorporates a check valve and is capable of controlling flow rate.

Each one of the solenoid valves 33,34,35,43,44,49,53,54,58,59,62,65,67,72,74,84B,89 has a return spring (not shown) and a solenoid that is adapted to be proportionally controlled by the controller (not shown) so that each solenoid valve is controlled to a position to achieve a balance between excitation force of the solenoid and restorative force of the spring.

Next, the operations and effects of the embodiment shown in FIG. 3 are explained hereunder.

When controlling hydraulic fluid fed from the main pumps 17A,17B of the hybrid type drive system 10 to the travel motors 2*tr*L,2*tr*R, the boom cylinder 8*bmc*, the stick cylinder 8*stc*, and the bucket cylinder 8*bkc*, the hydraulic actuator control circuit 25 disengages the clutch 88 so that the energy recovery motor 86 driven by return fluid discharged from the boom cylinder 8*bmc* efficiently inputs driving power to the boom motor generator 87, which is under no-load condition, and that the generated electric power is stored in the electric power storage device 23 of the hybrid type drive system 10. When the clutch 88 is engaged, electric power fed from the electric power storage device 23 of the hybrid type drive system 10 enables the boom motor generator 87 to function as an electric motor to drive the boom assist pump 84*as* so that hydraulic fluid is fed from the boom assist pump 84*as* to the boom cylinder 8*bmc*. Thus, energy of return fluid discharged from the boom cylinder 8*bmc* can be effectively recovered even in an open circuit.

The configuration described above is particularly beneficial when the boom 8*bm* of the work equipment 8 descends due to its own weight, because the energy of the return fluid discharged from the head side of the boom cylinder 8*bmc* is absorbed by the energy recovery motor 86 and the boom motor generator 87 and efficiently stored in the electric power storage device 23 of the hybrid type drive system 10.

At that time, the return fluid discharged from the boom cylinder 8*bmc* into the return fluid passage 55 is divided into the return passage 56 and the return passage 57, and the proportion of divided flows of the fluid is controlled by the flow rate ratio control valve 58,59. With its flow rate being controlled by the flow rate ratio control valve 58,59, the fluid in the return passage 56 drives the energy recovery motor 86 so that the energy recovery motor 86 drives the boom motor generator 87 to feed electric power to the electric power storage device 23 of the hybrid type drive system 10. Therefore, the configuration according to the present invention is capable of gradually increasing the flow rate proportion of the fluid distributed towards the energy recovery motor 86 from the moment when return fluid starts to flow from the boom cylinder 8*bmc*, thereby preventing occurrence of shock, as well as ensuring stable function of the boom cylinder 8*bmc* by preventing a sudden change in load to the boom cylinder 8*bmc*.

In other words, when the boom 8*bm* of the work equipment 8 descends due to its own weight, gradual increase of the flow rate proportion of the return fluid distributed from the head side of the boom cylinder 8*bmc* towards the energy recovery motor 86 enables the energy recovery motor 86 to smoothly absorb the energy of the return fluid, and the prevention of a sudden change in load to the boom cylinder 8*bmc* stabilizes the descending action of the boom 8*bm* due to its own weight.

The solenoid valve 58 and the solenoid valve 59 of the flow rate ratio control valve 58,59 may each be disposed at desired, separate locations in the return passage 56 and the return passage 57 respectively. Furthermore, the flow rate ratio control valve 58,59 is capable of controlling return fluid flowing towards the energy recovery motor 86 at a desired flow rate and flow rate ratio by controlling an aperture of each respective return passage 56,57 separately and independently of each other.

When stopping the upper structure 4, which is being rotated on the lower structure 2 by the swing motor generator 4*sw* functioning as an electric motor, the swing control circuit 28 operates the swing motor generator 4*sw* to function as a generator. Thus, the rotation of the upper structure 4 can be braked, while the electric power generated by the swing motor generator 4*sw*, together with the electric power generated by the boom motor generator 87 driven by the energy recovery motor 86, can be efficiently recovered to the electric power storage device 23 of the hybrid type drive system 10 and effectively regenerated as pump power for the hybrid type drive system 10.

As the solenoid valve 89 between bucket and boom is disposed in the boom cylinder hydraulic fluid feeding passage 48, a combined amount of hydraulic fluid can be fed from the main pump 17A, which may also be referred to as the first main pump, and the boom assist pump 84*as* to the boom cylinder 8*bmc* by opening the solenoid valve 89 to the one-way direction flow position. Therefore, it is possible to increase the speed of boom raising action by the boom cylinder 8*bmc* and improve working efficiency. Furthermore, a high pressure to the bucket cylinder 8*bkc* can be ensured by closing the solenoid valve 89.

As the solenoid valve 74 between bucket and stick is disposed in the circuit-to-circuit communicating passage 73 between bucket and stick, controlling the solenoid valve 74 at the one-way direction flow position and closing the solenoid valves 72,89 enables hydraulic fluid that would otherwise be fed from the first main pump 17A to the boom cylinder hydraulic fluid feeding passage 48 to flow through the solenoid valve 74 into the stick cylinder hydraulic fluid feeding passage 61 and merge with the hydraulic fluid fed from the second main pump 17B to the stick cylinder hydraulic fluid feeding passage 61, thereby feeding the combined hydraulic fluid to the stick cylinder 8*stc* and consequently increasing the speed of the stick cylinder 8*stc*. Thus, working efficiency can be improved.

Controlling the solenoid valve 74 at the flow interruption position separates the stick system from the boom system and the bucket system, enabling the control of their pressures to be done independently of each other. This is particularly effective for ensuring generation of a high pressure at the bucket cylinder 8*bkc*.

According to the embodiment described above, the solenoid valve 72 between stick and boom is disposed in the circuit-to-circuit communicating passage 71 between stick and boom for linking the stick cylinder hydraulic fluid feeding passage 61 and the head-side of the boom cylinder 8*bmc*. Therefore, in addition to the confluent flow of hydraulic fluid fed to the head-side of the boom cylinder 8*bmc* through the left chamber of the solenoid valve 49, which serves to control the direction of the hydraulic fluid, hydraulic fluid can be fed from the second main pump 17B through the solenoid valve 72 to the head-side of the boom cylinder 8*bmc* by controlling the solenoid valve 72 between stick and boom to the one-way direction flow position. The aforementioned confluent flow of hydraulic fluid is comprised of the hydraulic fluid that is discharged from the first main pump 17A, passes through the solenoid valve 89, and subsequently merges with the boom assist pump 84 as. As a result, the speed of boom raising action by the boom cylinder 8*bmc* is increased, and working efficiency is consequently improved. Furthermore, by closing the solenoid valve 72, supply of hydraulic fluid to the stick cylinder 8*stc* can be ensured, resulting in increased speed of the stick cylinder 8*stc*.

The boom control circuit 45 can be separated from the main pumps 17A,17B by closing the solenoid valves 72,89 to their respective flow interruption positions.

A variety of combinations of switched positions of the solenoid valves 72,74,89 increase flexibility of the combination of control circuits, enabling flexibility in making changes in the system configuration. Furthermore, using a hybrid system enables improved fuel efficiency of the engine 11.

The present invention is applicable to swing-type work machines such as a hydraulic excavator.

The invention claimed is:

1. A work machine comprising:

a lower structure adapted to be driven by a travel motor;

an upper structure that is rotatable on the lower structure by a swing motor generator, and a work equipment mounted on the upper structure and comprising a boom, a stick, and a bucket that are sequentially connected and adapted to be pivoted by a boom cylinder, a stick cylinder and a bucket cylinder respectively;

the work machine further including:

a hybrid type drive system comprising:

an engine, a motor generator adapted to be driven by the engine so as to function as a generator as well as receive electric power so as to function as an electric motor, an electric power storage device that serves to store electric power fed from the motor generator functioning as a generator, as well as feed electric power to the motor generator functioning as an electric motor, and a main pump adapted to be driven either one of or both the engine and the motor generator;

a travel/stick/bucket control circuit that serves to control hydraulic fluid fed from the main pump of the hybrid type drive system to the travel motor, the stick cylinder, and the bucket cylinder;

a boom control circuit that includes a boom pump, which is provided separately from the main pump of the hybrid type drive system, the boom control circuit serving to control hydraulic fluid fed from the boom pump to the boom cylinder; and a swing control circuit that serves to:

feed electric power from the electric power storage device of the hybrid type drive system to the swing motor generator so that the swing motor generator functions as an electric motor, and recover to the electric power storage device electric power generated by the swing motor generator functioning as a generator during braking of rotating motion of the upper structure;

wherein the boom control circuit further includes:

an energy recovery motor provided in a return fluid passage through which return fluid discharged from the boom cylinder flows, a boom motor generator adapted to be driven by the energy recovery motor so as to function as a generator for feeding electric power to the electric power storage device of the hybrid type drive system as well as be driven by electric power fed from the electric power storage device so as to function as an electric motor, and a clutch that serves to transmit electric power from the boom motor generator functioning as an electric motor to the boom pump and disengage the boom motor generator functioning as a generator from the boom pump.

2. A work machine as claimed in claim 1, wherein:

the return fluid passage includes:

a return passage provided with the energy recovery motor, another return passage that branches off the upstream side of the energy recovery motor, and a flow rate ratio control valve for controlling a flow rate ratio of a flow rate in the first mentioned return passage and a flow rate in the other return passage.

3. A work machine as claimed in claim 1, wherein:

the energy recovery motor is provided in the return fluid passage that extends from a head-side of the boom cylinder.

4. A work machine as claimed in claim 3, wherein:

the return fluid passage includes:

a return passage provided with the energy recovery motor, another return passage that branches off the upstream side of the energy recovery motor, and a flow rate ratio control valve for controlling a flow rate ratio of a flow rate in the first mentioned return passage and a flow rate in the other return passage.

5. A work machine as claimed in claim 3, wherein:

the work machine includes a plurality of main pumps; and the hydraulic actuator control circuit further includes:

a boom cylinder hydraulic fluid feeding passage for feeding hydraulic fluid from one of the main pumps to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage that serves to feed hydraulic fluid from another main pump to the stick cylinder, a solenoid valve between bucket and boom that is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, and a solenoid valve between bucket and stick that is disposed in the circuit-to-circuit communicating passage between bucket and stick and adapted to be moved between a position for enabling flow in one direction from the bucket cylinder hydraulic fluid feeding passage to the stick cylinder hydraulic fluid feeding passage and a position for interrupting the flow of fluid.

6. A work machine as claimed in claim 5, wherein:

the work machine further includes:

a circuit-to-circuit communicating passage between stick and boom for providing fluid communication between the stick cylinder hydraulic fluid feeding passage and the head-side of the boom cylinder, and a solenoid valve between stick and boom that is disposed in the circuit-to-circuit communicating passage between stick and boom and adapted to be moved between a position for enabling flow in one direction from the stick cylinder hydraulic fluid feeding passage to the head-side of the boom cylinder and a position for interrupting the flow of fluid.

7. A work machine as claimed in claim 2, wherein:

the work machine includes a plurality of main pumps; and the hydraulic actuator control circuit further includes:

a boom cylinder hydraulic fluid feeding passage for feeding hydraulic fluid from one of the main pumps to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage that serves to feed hydraulic fluid from another main pump to the stick cylinder, a solenoid valve between bucket and boom that is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, and a solenoid valve between bucket and stick that is disposed in the circuit-to-circuit communicating passage between bucket and stick and adapted to be moved between a position for enabling flow in one direction from the bucket cylinder hydraulic fluid feeding passage to the stick cylinder hydraulic fluid feeding passage and a position for interrupting the flow of fluid.

8. A work machine as claimed in claim 7, wherein:

the work machine further includes:

a circuit-to-circuit communicating passage between stick and boom for providing fluid communication between the stick cylinder hydraulic fluid feeding passage and the head-side of the boom cylinder, and a solenoid valve between stick and boom that is disposed in the circuit-to-circuit communicating passage between stick and boom and adapted to be moved between a position for enabling flow in one direction from the stick cylinder hydraulic fluid feeding passage to the head-side of the boom cylinder and a position for interrupting the flow of fluid.

9. A work machine comprising:

a lower structure adapted to be driven by a travel motor;

an upper structure that is rotatable on the lower structure by a swing motor generator, and a work equipment mounted on the upper structure and comprising a boom, a stick, and a bucket that are sequentially connected and adapted to be pivoted by a boom cylinder, a stick cylinder and a bucket cylinder respectively;

the work machine further including:

a hybrid type drive system comprising:

an engine, a motor generator adapted to be driven by the engine so as to function as a generator as well as receive electric power so as to function as an electric motor, an electric power storage device that serves to store electric power fed from the motor generator functioning as a generator, as well as feed electric power to the motor generator functioning as an electric motor, and a main pump adapted to be driven either one of or both the engine and the motor generator;

a hydraulic actuator control circuit that serves to control hydraulic fluid fed from the main pump of the hybrid type drive system to the travel motor, the boom cylinder, the stick cylinder, and the bucket cylinder; and a swing control circuit that serves to:

feed electric power from the electric power storage device of the hybrid type drive system to the swing motor generator so that the swing motor generator functions as an electric motor, and recover to the electric power storage device electric power generated by the swing motor generator functioning as a generator during braking of rotating motion of the upper structure;

wherein the hydraulic actuator control circuit further includes:

a boom assist pump that serves to assist flow rate of hydraulic fluid fed from the main pump of the hybrid type drive system to the boom cylinder, an energy recovery motor provided in a return fluid passage through which return fluid discharged from the boom cylinder flows, and a boom motor generator adapted to be driven by the energy recovery motor so as to function as a generator for feeding electric power to the electric power storage device of the hybrid type drive system as well as be driven by electric power fed from the electric power storage device so as to function as an electric motor.

10. A work machine as claimed in claim 9, wherein:

the energy recovery motor is provided in the return fluid passage that extends from a head-side of the boom cylinder.

11. A work machine as claimed in claim 10, wherein:

the return fluid passage includes:

a return passage provided with the energy recovery motor, another return passage that branches off the upstream side of the energy recovery motor, and a flow rate ratio control valve for controlling a flow rate ratio of a flow rate in the first mentioned return passage and a flow rate in the other return passage.

12. A work machine as claimed in claim 9, wherein:

the return fluid passage includes:

a return passage provided with the energy recovery motor, another return passage that branches off the upstream side of the energy recovery motor, and a flow rate ratio control valve for controlling a flow rate ratio of a flow rate in the first mentioned return passage and a flow rate in the other return passage.

13. A work machine as claimed in claim 9, wherein:

the work machine includes a plurality of main pumps; and the hydraulic actuator control circuit further includes:

a boom cylinder hydraulic fluid feeding passage for feeding hydraulic fluid from one of the main pumps to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage that serves to feed hydraulic fluid from another main pump to the stick cylinder, a solenoid valve between bucket and boom that is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, and a solenoid valve between bucket and stick that is disposed in the circuit-to-circuit communicating passage between bucket and stick and adapted to be moved between a position for enabling flow in one direction from the bucket cylinder hydraulic fluid feeding passage to the stick cylinder hydraulic fluid feeding passage and a position for interrupting the flow of fluid.

14. A work machine as claimed in claim 13, wherein:

the work machine further includes:

a circuit-to-circuit communicating passage between stick and boom for providing fluid communication between the stick cylinder hydraulic fluid feeding passage and the head-side of the boom cylinder, and a solenoid valve between stick and boom that is disposed in the circuit-to-circuit communicating passage between stick and boom and adapted to be moved between a position for enabling flow in one direction from the stick cylinder hydraulic fluid feeding passage to the head-side of the boom cylinder and a position for interrupting the flow of fluid.

15. A work machine as claimed in claim 9, wherein:

the hydraulic actuator control circuit further includes a clutch that serves to transmit electric power from the boom motor generator functioning as an electric motor to the boom assist pump and disengage the boom motor generator functioning as a generator from the boom assist pump.

16. A work machine as claimed in claim 15, wherein:

the work machine includes a plurality of main pumps; and the hydraulic actuator control circuit further includes:

a boom cylinder hydraulic fluid feeding passage for feeding hydraulic fluid from one of the main pumps to the boom cylinder, a bucket cylinder hydraulic fluid feeding passage that branches off the boom cylinder hydraulic fluid feeding passage and serves to feed hydraulic fluid to the bucket cylinder, a stick cylinder hydraulic fluid feeding passage that serves to feed hydraulic fluid from another main pump to the stick cylinder, a solenoid valve between bucket and boom that is disposed in the boom cylinder hydraulic fluid feeding passage, at a location between the branching point of the bucket cylinder hydraulic fluid feeding passage and a point at which a passage from the boom assist pump joins the boom cylinder hydraulic fluid feeding passage, the solenoid valve between bucket and boom being adapted to be moved between a position for enabling the hydraulic fluid that would otherwise be fed to the bucket cylinder to be fed to the boom cylinder in a one-way direction and a position for interrupting the flow of fluid, a circuit-to-circuit communicating passage between bucket and stick for providing fluid communication between the bucket cylinder hydraulic fluid feeding passage and the stick cylinder hydraulic fluid feeding passage, and a solenoid valve between bucket and stick that is disposed in the circuit-to-circuit communicating passage between bucket and stick and adapted to be moved between a position for enabling flow in one direction from the bucket cylinder hydraulic fluid feeding passage to the stick cylinder hydraulic fluid feeding passage and a position for interrupting the flow of fluid.

17. A work machine as claimed in claim 16, wherein:

the work machine further includes:

a circuit-to-circuit communicating passage between stick and boom for providing fluid communication between the stick cylinder hydraulic fluid feeding passage and the head-side of the boom cylinder, and a solenoid valve between stick and boom that is disposed in the circuit-to-circuit communicating passage between stick and boom and adapted to be moved between a position for enabling flow in one direction from the stick cylinder hydraulic fluid feeding passage to the head-side of the boom cylinder and a position for interrupting the flow of fluid.

* * * * *

UNITED STATES PATENT AND TRADEMARK OFFICE

CERTIFICATE OF CORRECTION

PATENT NO. : 7,562,472 B2
APPLICATION NO. : 11/575045
DATED : July 21, 2009
INVENTOR(S) : Shoji Tozawa et al.

It is certified that error appears in the above-identified patent and that said Letters Patent is hereby corrected as shown below:

Title page, item "(86) PCT No.," please delete "PCT/JP2006/007532" and insert

-- PCT/JP2006/307532 -- therefor.

Signed and Sealed this

Eighth Day of September, 2009

David J. Kappos

David J. Kappos
*Director of the United States Patent and Trademark Office*